US005198976A

United States Patent [19]

Form et al.

[11] Patent Number: 5,198,976

[45] Date of Patent: Mar. 30, 1993

[54] MULTIFUNCTION INTERACTIVE AUTOMATIC BOWLING ALLEY SYSTEM UTILIZING A TOUCH SCREEN CONSOLE

[75] Inventors: Michael A. Form, Southborough; Gene L. Greystone, Boston; Charles L. Housman, Cambridge, all of Mass.

[73] Assignee: Computer Sport Systems, Inc., Cambridge, Mass.

[21] Appl. No.: 664,550

[22] Filed: Mar. 4, 1991

Related U.S. Application Data

[63] Continuation of Ser. No. 470,963, Jan. 26, 1990, abandoned, which is a continuation-in-part of Ser. No. 267,341, Nov. 2, 1988, abandoned, which is a continuation-in-part of Ser. No. 849,806, Apr. 9, 1986, abandoned.

[51] Int. Cl.[5] ..... A63D 5/04

[52] U.S. Cl. ..... 364/410; 273/54 C; 340/323 B

[58] Field of Search ..... 364/410, 411, 412; 273/48, 54 C; 340/323 R, 323 B; 381/51

[56] References Cited

U.S. PATENT DOCUMENTS

| | | | |
|---|---|---|---|
| 3,907,290 | 9/1975 | Fischer et al. | 273/54 C |
| 4,131,948 | 12/1978 | Kaenel | 364/900 |
| 4,302,010 | 11/1981 | Kaenel | 273/54 C |
| 4,449,186 | 5/1984 | Kelly et al. | 364/407 |
| 4,547,851 | 10/1985 | Kurland | 364/401 |
| 4,563,758 | 1/1986 | Paternostro | 381/51 |
| 4,722,053 | 1/1988 | Dubno et al. | 364/401 |
| 4,775,784 | 10/1988 | Stark | 235/380 |
| 4,831,242 | 5/1989 | Englehardt et al. | 235/382 |
| 4,887,813 | 12/1989 | Chiles, III et al. | 273/54 C |
| 5,101,354 | 3/1992 | Mowers et al. | 364/410 |

FOREIGN PATENT DOCUMENTS

| | | | |
|---|---|---|---|
| 0103317 | 3/1984 | European Pat. Off. . | |
| 2075231 | 11/1981 | United Kingdom | 273/54 C |

OTHER PUBLICATIONS

"Microprocessors and LSI Devices are Prime Contributors to Design of Automatic Bowling Scorer", *Computer Design*, vol. 15, No. 9, Sep. 1976, 50, 54, 58, 62, 66.

*Primary Examiner*—Roy N. Envall, Jr.
*Assistant Examiner*—A. Bodendorf
*Attorney, Agent, or Firm*—Wolf, Greenfield & Sacks

[57] ABSTRACT

This invention provides an interactive multifunction bowling alley system which utilizes a computer adapted to store information concerning selected bowling alley functions. A touch screen device is located at the patron area for at least selected ones of the bowling alley lanes. By permitting the user to make appropriate selections from menus appearing on a monitor of the touch screen device, such selections being made by the user touching appropriate areas on the monitor screen, functions such as automatic scoring, food or beverage ordering, entertainment such as games, problem solving, announcements, payment/charge and the like may be performed. In response to a first menu selection, menus and/or instructions may appear on the monitor relevant to the selected function which a user may utilize in performing the selected function.

16 Claims, 5 Drawing Sheets

MULTIFUNCTION INTERACTIVE AUTOMATIC BOWLING ALLEY SYSTEM UTILIZING A TOUCH SCREEN CONSOLE

This is a continuation of copending application Ser. No. 07/470,963 filed on Jan. 26, 1990, abandoned, which is continuation in part, of application Ser. No. 07/267,341, filed Nov. 2, 1988, abandoned which is a continuation-in-part of application Ser. No. 9,849,806, filed Apr. 9, 1986, abandoned.

FIELD OF THE INVENTION

This invention relates to an interactive bowling alley system and more particularly to a system for performing a variety of functions in a bowling alley environment including automatic bowling scoring and projecting such scores onto a lighted screen or video monitor.

BACKGROUND OF THE INVENTION

The sport of bowling enjoys a large popularity in the United States and many foreign countries. Although scoring for a game of bowling is relatively simple, many people are unfamiliar with the rules and thus cannot derive full enjoyment from the game because they are unable to properly score the game. Thus, these people cannot compare their scores to the scores of others because the scores have been kept on an inconsistent basis. In addition, unfamiliarity with scoring delays the game, thus reducing the profits of the bowling establishment operator.

Unfamiliarity with rules is a special problem in many bowling establishments which cater to bowling "leagues" in which many teams bowl competitively against each other. In a league bowling situation it is especially important for the scoring of each team to be kept in a consistent manner so that the scores can be readily compared to determine which team has done the best.

Accordingly, a number of systems have been developed which can automatically keep track of bowling scores on a real time basis during a game These systems typically consist of a computer which accepts inputs from conventional automatic pin scoring equipment to determine the number of pins standing after a ball has been rolled. While these systems operate in a satisfactory manner with automatic pin scoring equipment they are difficult for the bowlers to use.

Typically, such systems force the user to communicate with the system by means of a standard computer keyboard with either a printed set of instructions or a video display which prompts the bowler to press the keys in a correct sequence. Different sequences may be used to enter a bowler's name or change a score which is displayed on the score monitor. This method of interaction has been found to be time consuming and error prone especially for unsophisticated or novice users. Quite often an incorrect key is pressed during a particular sequence and then due to the inflexibility of the system, it is difficult to change the sequence or to enter correct information. The result is frustration of the users and inconsistent scores. A more specific object of the present invention to provide an automatic scoring system which minimizes the likelihood that users will make incorrect or inappropriate choices.

In addition to performing automatic scoring, there are a number of additional functions which need to be performed at a bowling alley which are not performed in optimum fashion by existing systems. Such functions include, but are in no way limited to, permitting patrons to order food and beverages without leaving the bowling alley site and without requiring the presence of a waiter or waitress to take orders. It would also be desirable if such food or beverage orders, and/or other services performed for the patron, including the payment for games bowled, could be automatically charged to the patron's credit card, debit card, account at the bowling alley, or the like so that a waiter or waitress would be required to merely deliver orders and not to collect money or to make extra trips between the alley and a central location to process credit cards or the like.

The operation and use of the system could also be enhanced and simplified by providing regular patrons with a machine readable membership card, by providing the systems with the capability of recognizing such patrons from a machine-read credit card, or by giving the patron a unique ID number which could be entered into the system in response to a system prompt. Once the machine recognizes the patron, it can automatically enter stored set-up information for the patron, eliminating the need to manually enter such information. The system could also store information on patron scores, handicap, birthday, etc. and could automatically update scores and handicaps as each game is played. The system could also keep track of games played by a patron and use this information to compute membership premiums, discounts or the like. The member ID card, either alone or in conjunction with a patron entered personal identification code, could be used to provide a security function for user charges or the release of stored information on the user.

Further, there may frequently be dead times between bowling games, when a lane is inoperative for some reason or at other times. It would be desirable if entertainment functions such as word games, video games or the like could be provided to the patrons during such lull times, either at no charge, or at a charge which could be made against a credit card, credit account or the like, to keep patrons amused during such intervals.

It would also be desirable if the same equipment which provided the various capabilities indicated above could also be utilized to perform various administrative and problem solving functions such as advising a front desk or a repair person located behind the alley when a problem develops in an alley requiring action, thus permitting the unproductive time in the use of an alley to be minimized. Such a system might also be utilized for performing other administrative functions.

Finally, it would be desirable if such a system could perform an announcement function, providing a patron on request with information on tournaments, league schedules, standings or the like, sales at the alley shop and the like.

Thus, it is an object of the present invention to provide an improved interactive automatic system for use at bowling alleys which is adapted to perform one or more of a variety of functions including, but not limited to, automatic or semi-automatic scoring, automatic ordering of refreshments (i.e., food and beverages), automatic charging for refreshments or other service, automatic administrative functions such as clearing problems on the alley, entertainment functions, announcement functions, and the like.

A more specific object of the present invention is to provide an automatic scoring system which minimizes the likelihood that users will make incorrect or inappropriate choices.

It is a further object of the present invention to provide an automatic scoring system which is interactive and guides the user to make the correct choices.

It is still another object of the present invention to provide an automatic scoring system which does not use a fixed keyboard or require the user to manipulate a set of keys.

It is still another object of the present invention to provide an automatic scoring system in which the user can interact with the system by merely touching an input device to cause an appropriate set of choices to appear on the screen.

It is still another object of the present invention to provide an automatic scoring system which is easy to use even for unsophisticated or novice bowlers.

It is yet another object of the present invention to provide an automatic scoring system which can easily connect to conventional pin scoring technology.

It is still another object of the present invention to provide an automatic scoring system which can easily be retrofitted into existing bowling establishments.

It is yet a further object of the present invention to provide an automatic scoring system which can easily be used in foreign countries with simple software changes in letters and symbols and without requiring changes in hardware such as keyboards.

SUMMARY OF THE INVENTION

The foregoing objects are achieved and the foregoing problems are solved in accordance with the teachings of this invention by providing an interactive bowling alley system which has a computer adapted to store information concerning selected bowling alley functions. A touch-screen device is located at the patron area for at least selected ones of the bowling alley lanes, the touch-screen device including a video monitor. A menu of the selected bowling alley functions appears on the video monitor under the control of the computer and a key area is provided on the monitor for each menu item. In response to the user touching the key area for a menu item, selected information is provided on the monitor to the user concerning the performance of the selected bowling alley function. Among the selected bowling alley functions are ordering refreshments, entertainment, problem correction, announcement, payment/charge, and scoring. The system would perform two or more of these function.

In response to the user touching a key area corresponding to one of the menu items, the computer is caused to provide to the monitor and to display thereon selected information concerning the function corresponding to the touched key area. The selected information could include a menu of available options for the selected function and/or instructions for performing the selected function. There is a key area provided on the monitor for each available option and there are key areas provided on the monitor for operation by a user in performing a selected function. In response to the user touching a key area for an available option, additional available options on the function are displayed or, if additional available options are not stored, the selected available option is performed. In response to displayed instructions, information corresponding to such key areas may be entered into the computer. As a result, a user may easily perform selected bowling alley functions without having prior computer knowledge or experience. In one illustrative embodiment of the invention, an automatic scoring device is controlled by a computer that interacts with users by means of a touch-screen device. The touch-screen device consists of a video monitor and a mechanism which allows the computer to sense the area of the screen which is touched by the user.

In operation, the computer controls the video monitor to present various operational choices to the user. The user then selects one of the choices by means of touching the screen. The software program running in the computer then interprets the selected area of the screen based on pin sense inputs, previous user choices and the particular operational sequence being executed at the time.

The computer may take further action which may include displaying additional choices or performing a requested transaction. Further choices which are presented to the user after each selection are those which are appropriate in the particular situation. Since only appropriate information and selection choices are provided, the probability of a user making an inappropriate response is reduced. Error correcting routines allow the user to easily modify an incorrect choice so that the user cannot reach a point at which he cannot appropriately respond. User frustration is reduced and user satisfaction with the sport of bowling is thereby increased.

DETAILED DESCRIPTION OF THE PREFERRED EMBODIMENT

Figure 1:
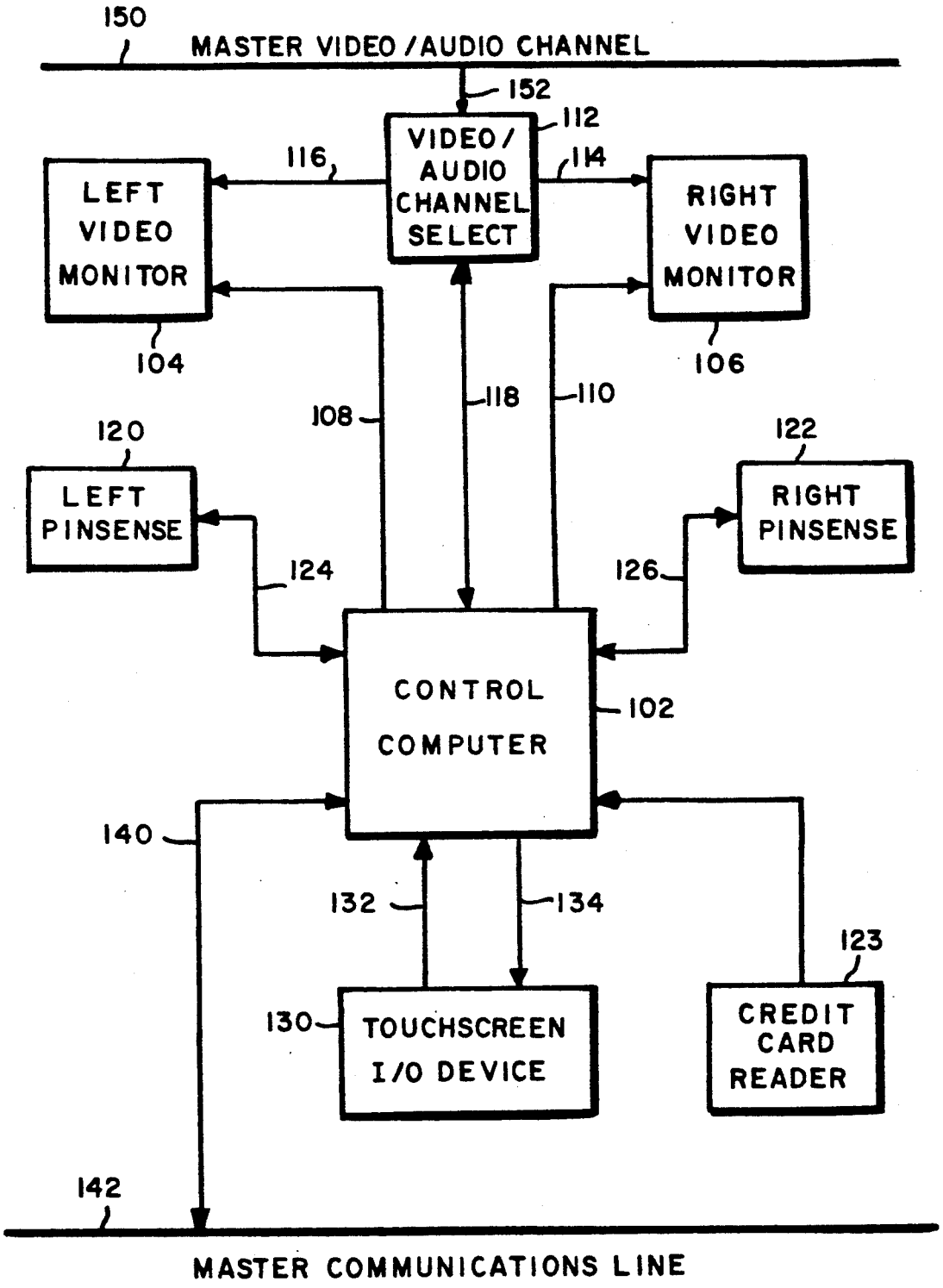
FIG. 1 of the drawing is a block diagram functional schematic showing the connection of the main system components for one pair of lanes.

FIG. 1 shows a block diagram electrical schematic of the interactive scoring system. The system is controlled and coordinated by means of a computer 102. Computer 102 receives inputs from a touch-screen input/output device 130, from pin sensing units 120 and 122 and from card reader 123. Computer 102 also displays information to the bowlers on video monitors 104 and 106 and may communicate with central locations such as the main desk, the pin setter area behind the pins or the snack bar by means of a master communication line 142.

In order to save cost, the automatic scoring unit is designed so that a single control computer 102 can handle bowling scoring information on two adjacent bowling lanes. Each lane has its own video monitor (such as monitors 104 and 106) and pin sensing units (corresponding to units 120 and 122). The unit may also have two touch-screen input devices to allow the bowlers to enter information. However, to reduce cost, the unit can also be designed to operate with a single touch-screen input/output device 130 which is typically located between the two lanes on the conventional console.

The control computer 102 displays the bowler's scores by means of video monitors 104 and 106. Typically these video monitors will be mounted over the bowlers consoles so that they can display the scores during play. The video monitors receive signals from either of two sources. For example, video monitor 104 can receive bowling score information, via cable 108, from control computer 102. However, in addition, monitor 104 can receive video signals from a master video audio channel 150. More particularly, computer 102 can control a master switch 112 by means of signals transferred bus 118 to connect monitor 104 to bus 150 by means of buses 152 and 116. This latter connection allows the monitor to receive video and audio signals from a central source. Such video and audio signals may, for example, advertise upcoming events or food or beverages available in the bowling alley snack area.

Similarly, the right lane monitor 106 may receive signals from computer 102, via cable 110, or master video and audio signals over bus 150, via buses 152 and 114 through video and audio channel select switch 112.

Computer 102 may also receive pin sense signals from the pin sense units 120 and 122. These units may be conventional pin sensing units which use either mechanical sensors or ultrasonic or infrared beams to sense the number of pins which remain standing after each ball is thrown. Alternatively, a passive pin sensing unit may be used. A suitable passive pin sensing arrangement is disclosed in copending U.S. patent application, Ser. No. 823,591, entitled "Pinfall Detector Using Video Camera", filed on Jan. 29, 1986, now U.S. Pat. No. 4,827,412 the disclosure of which is hereby incorporated by reference.

Pin sensing units 120 and 122, in addition to sensing the number of pins which remain standing after a ball is thrown, also sense whether a foul has been committed and keep track of the number balls thrown in each lane. Computer 102 receives the pinfall, foul and ball information via bus 124 from pin sense unit 120 and, via bus 126, from via sense unit 122.

The bowlers interact with computer 102 by means of touch-screen input/output device 130. Device 130 may receive signals from computer 102, via bus 134, and may provide signals to computer 102 via bus 132. Touch-screen input/output device 130 is a conventional device which typically consists of a video monitor screen on which is mounted a touch-sensitive detection unit. The touch sensitive unit may be an infrared detection unit or a transparent, contact-sensitive array.

A conventional infrared detection unit has a plurality of infrared sources and infrared detectors arranged along the edges of the video screen. The infrared sources generate a plurality of infrared beams which are received by the detectors. The beams form an intersecting grid pattern over the face of the video display. When the user places his finger on the screen face one or more of the beams are interrupted and the device forwards information to the controlling computer indicating which area of the screen has been touched by the user. Alternatively, the plurality of infrared beams may be generated by a single infrared source and a combination of rotating and fixed mirrors. With the latter type of system a single infrared sensor may be used to detect the beams. A dedicated microprocessor is used to process the detected information to determine where the user has touched the screen.

A conventional contact-sensitive detection unit consists of two sheets of transparent plastic which have electrical conductors mounted on the sides of the plastic sheets which face each other. The plastic sheet/ electrical conductor array overlays the video screen. Pressing on the sheets in an area of the screen electrically shorts the two layers sending signals to the computer indicating the area of the screen which has been pressed. Alternatively, a non-switched capacitive sensor array may be used which uses the change in capacitance which results from touching of the screen to detect the position of the user's finger.

In the case of any of the detection units, suitable software routines in the control computer 102 convert the screen location into a selection by the user.

The advantage of the touch-screen and video monitor combination is that the controlling computer 102 can easily change the display of information on the touch-screen video screen so that only information which is relevant or appropriate at a particular time is displayed to the user, thus simplifying the user's choice and minimizing the chance that the user will make an error or enter inappropriate information. In particular, the computer can define a plurality of "key areas" on the touch-screen device. These areas act like physical keys in that they cause the computer to perform a designated action when pressed. However, since the key areas are merely defined areas on a video screen, they can be quickly and easily changed in number, position and appearance to present appropriate selections to the user. The key areas can contain standard logos or "icons" representing common tasks or choices. Thus, the system can be easily used in foreign contries without replacing a keyboard simply by reprogramming the key areas with symbols or words appropriate to a specific country.

For example, if a user wanted to enter his or her name and touched an appropriate box displayed on the touch-screen video screen which designated alphabetic entry, then the control computer would cause the touch-screen device to display an alphabetic keyboard on its video screen. The user would then be able to enter his name by touching the letters corresponding to the proper spelling. Once the name is entered, the video display associated with the touch-screen device would return to a standard menu of operations and the alphabet key areas would be removed from the touch-screen since they are no longer necessary and could confuse the user.

The touch-screen hardware and software typically presents choices to the user in areas of the screen defined by line boxes drawn by the computer. The user chooses or activates the appropriate selections by touching the area of the video screen within the appropriate box. Data sent by the touch-screen input device is interpreted by software running in control computer 102 to determine if the user has touched or selected one of the currently available actions displayed on the screen. The computer then executes the appropriate routine requested and may display another set of selections which are appropriate at that point in the controlling sequence.

In operation, the software routines which operate in control computer 102 are arranged into a set of interactive sequences. Such a sequence may, for example, allow the bowler to enter his name, to change or to correct scores or to change colors on the video display so that the display can be used during league bowling. Each of the interactive sequences defined by the software has its own unique set of video displays which may appear on either or both of the main video monitor and the touch-screen video screen.

An example of such an interactive sequence is depicted in FIGS. 2–9 which schematically illustrate screen displays which are constructed by computer 102 on touch-screen device 130 and video monitors 104 or 106. The illustrated sequence allows a user to enter his name and correct or enter scores during the actual game. The actual software routines which cause computer 102 to perform the disclosed sequences are conventional and are not described in detail. The coding for such sequences would be familiar to those skilled in the art.

Figure 2:
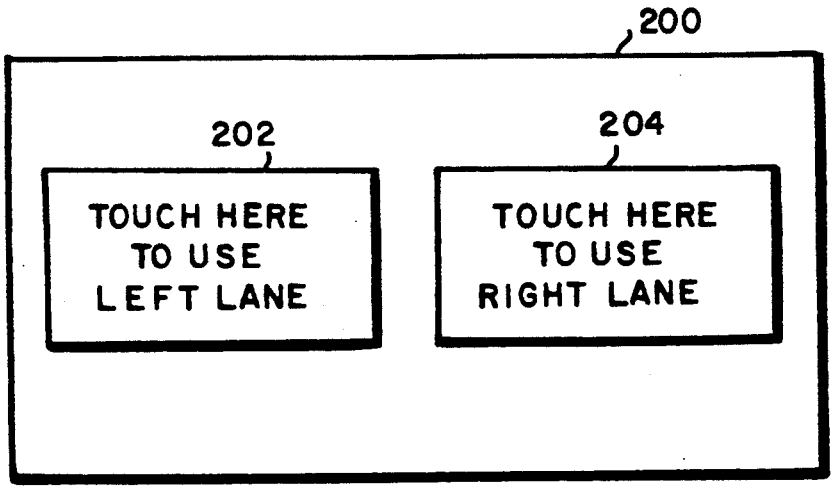
FIG. 2 is a schematic diagram of an initial touch-screen display for selecting a lane to be activated.

The sequence begins with the screen display shown in FIG. 2 which would be displayed by computer 102 when the pair of bowling lanes which are controlled by the computer are initially activated. This screen display would appear on the video screen associated with touch-screen device 130 and consists of two box areas, 202 and 204. These areas are used to select the lane which is to be activated. Touching box 202 activates the left lane causing computer 102 to display information on monitor 104 and to use inputs from pin sense device 120. Alternatively, touching the box 204 causes computer 102 to accept inputs from right pin sense unit 122 and display information on monitor 106.

Figure 3:
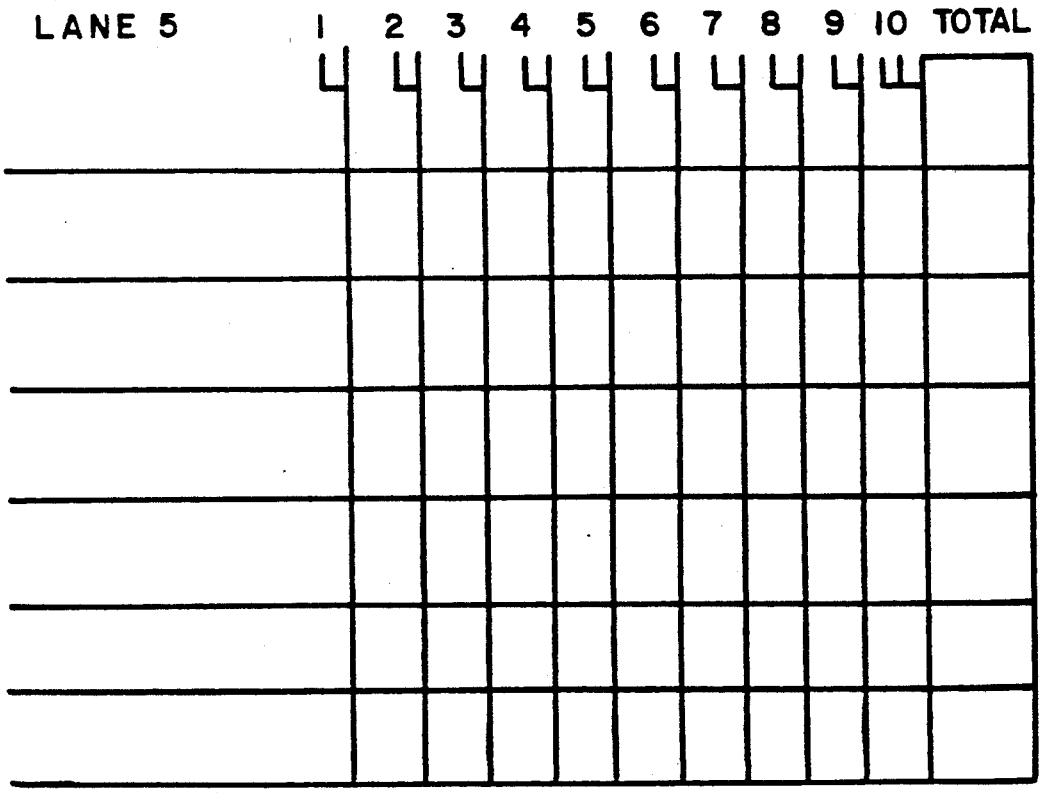
FIG. 3 is a schematic diagram of a a display presented by the computer of the main system monitor.

After the bowler selects the lane which is to be activated, controlling computer 102 displays a typical bowling score grid on the video monitor (monitor 104 or 106) of the lane which has been selected. A typical scoring grid is shown in FIG. 3.

Figure 4:
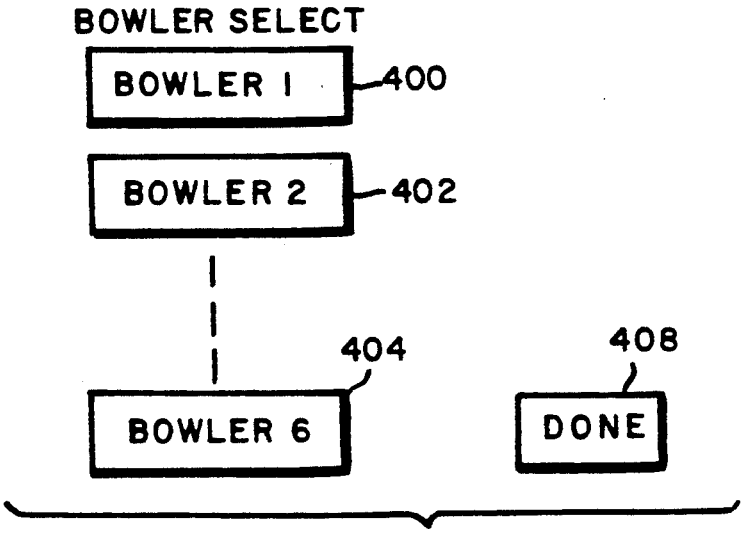
FIG. 4 is a secondary touch-screen display for selecting a bowler.
Figure 5:
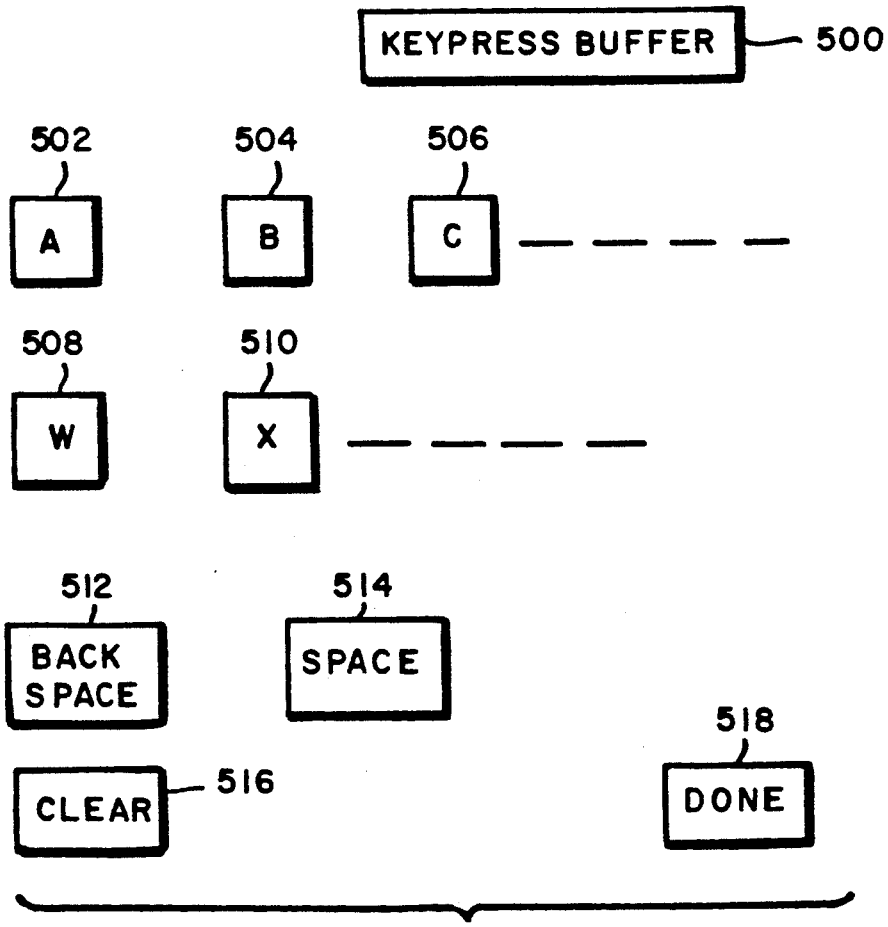
FIG. 5 is a schematic diagram of an editing touch-screen display including an alphabetic key set for entering a bowler name.

In addition, the touch-screen video display is cleared by computer 102 and the display is replaced by a bowler select screen as shown in FIG. 4. This latter screen consists of a plurality of key areas (illustratively, six areas) indicating bowlers who will be using the selected lane. In addition, a "done" key area 406 is included so that the users can inform computer 102 when information for all of the bowlers has been entered.

An information entry routine is begun when a user touches the video screen in one of the bowler selection key areas. For example, a user may touch key area 400 to enter the name of bowler 1. When this action is decoded by computer 102, the touch-screen video screen is cleared and replaced with the screen display shown in FIG. 5.

This latter screen display includes an alphabetic key array consisting of twenty-six key areas (of which key areas 502–510 are shown), a backspace key area 512, a space key area 514, a clear key area 516 and a done key area 518. In addition, an area 500 is designated as a keypress buffer. Touching any of the alphabetic key areas 502–510 causes the computer to display the corresponding letter in the keypress buffer area 500 so that the user may see what has been entered and correct errors using the backspace key area 512 or the clear key area 516.

When the correct name has been entered, the user touches the done key area 518, which causes computer 102 to display the entered name on the correct line number in the scoring grid display shown in FIG. 3. In addition, the alphabetic display is removed from the touch-screen video screen and the bowler entry screen shown in FIG. 4 is re-displayed so that the next bowler may enter his name on the proper line. In his manner, all of the bowlers who are using the selected lane enter their names which are then displayed on the proper line of the scoring grid shown in FIG. 3. When the last bowler has entered his name, the done area 406 is pressed which causes computer 102 to clear the touch-screen display and display the "main" menu screen shown in FIG. 6.

The "main" menu consists of seven key areas designated 600–612. A touch to area 600 causes the bowling scoring grid on the video monitor to highlight (or otherwise emphasize) the scoring line associated with first bowler so that bowling may commence.

Conversely, a touch to the bowler entry area 602 allows bowler names to added or deleted or names to be corrected on the scoring grid.

A touch to area 604 allows the colors used on the main video monitor 104 to be changed so that various league colors can be displayed Key areas 608 and 610 are used to select the lane on which scoring is to take place so that two lanes can use the same computer equipment.

Two additional areas 606 and 612 are provided. Area 606 may be touched to cause computer 102 to signal a central computer in the main desk or snack area via master communication link 142 and bus 140. Touching key area 606 may also cause touch screen device 130 to display various food or drink choices. These choices can be selected and forwarded directly to the appropriate area via the master communication link 142 to insure fast service and to eliminate the necessity of dispatching live personnel to each lane to solicit orders.

Special features area 612 can be used to display additional selections. These selections can be varied to suit the individual boiling establishment and to increase operator revenue. The choices may range from reporting equipment problems directly to the main desk area to making non-bowling games or other additional services available to the patrons. For example, non-bowling games, such as video games, may be provided to allow the patrons to play while waiting for all members of the party to arrive in the case of league play or while waiting for members of a single party to change shoes, etc.

Assuming that a user touches the "start scoring" area 600, the active user's line in the scoring grid is highlighted on the main monitor display 104 and the touch screen video display is cleared and replaced by new display to indicate additional selection possibilities now available. This new display is shown in FIG. 7.

Figure 6:
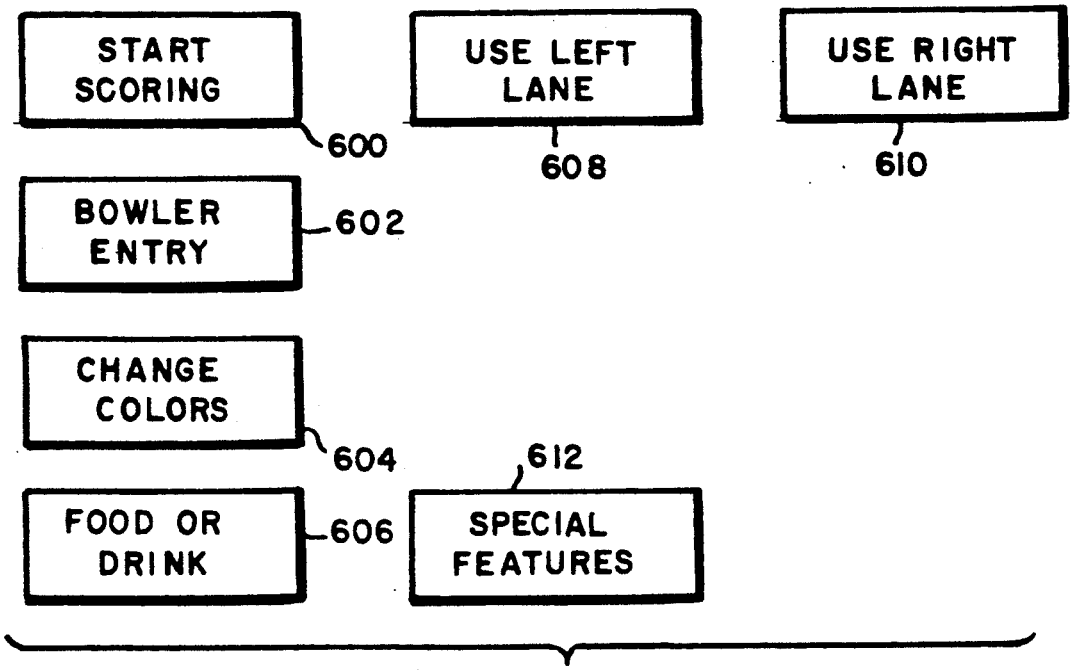
FIG. 6 is a diagram of the main menu touch-screen display.
Figure 7:
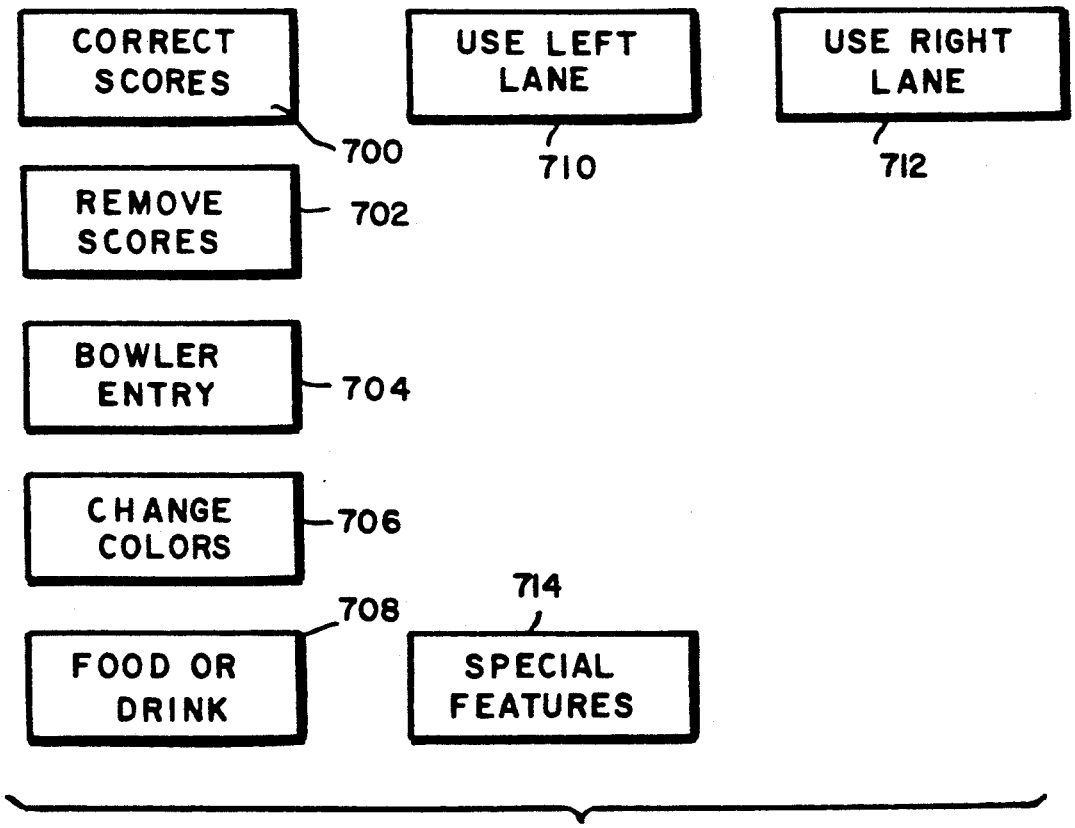
FIG. 7 is a schematic diagram of a secondary menu touch-screen display which is displayed during actual bowling.

In FIG. 7, the "start scoring" key area shown in FIG. 6 has been changed to two areas, 700 and 702, which are indicated as "correct scores" and "remove scores" areas because these latter selections are only appropriate after bowling has begun. The "correct scores" area 700 is used to correct or adjust scores as appropriate during the bowling sequence. Similarly, the "remove scores" area 702 is used to remove scores of bowlers who have finished bowling. The remaining areas, bowler entry 704, change colors 706, food or drink 708, special features 714 and the right and left lane areas, 710 and 712, are the same as previously described.

Assume, for example, bowler number 2 wants to correct his score in the second half of the second frame.

Figure 8:
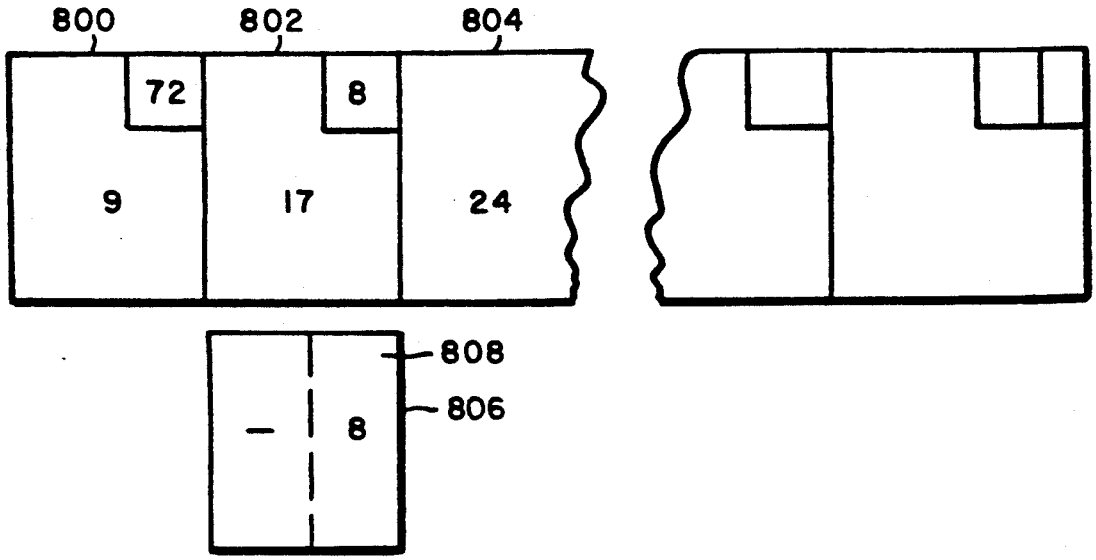
FIG. 8 is a schematic diagram of a secondary touch-screen display which allows editing of scores.

In this case, the bowler touches the "correct scores" key area 700. This action causes the touch-screen display shown in FIG. 7 to be cleared and the bowler select screen shown in FIG. 4 to be re-displayed on the touch-screen video screen. Bowler 2 would then touch key area 402 causing the bowler's scoring line of the scoring grid displayed on video monitor 104 to be displayed on the touch-screen display as shown in FIG. 8.

Figure 9:
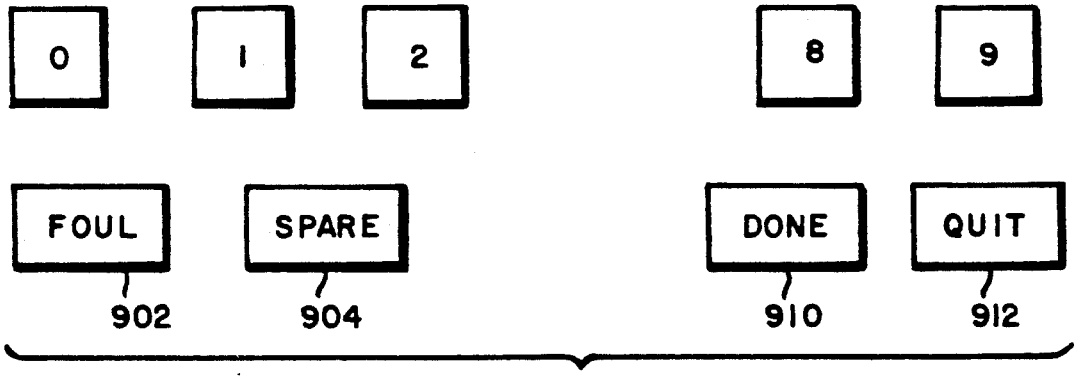
FIG. 9 is a schematic diagram of a secondary editing touch-screen display.

To correct a score, the bowler would then touch the second frame area 802 This latter action causes this area to be highlighted and also displayed underneath the frame 802 shown as area 806. A touch to the second ball frame half 808 causes that half to be highlighted and replaced with a numeric key path layout which is shown in FIG. 9. The bowler would then enter the appropriate score using the key pad. In addition to numeric entries, the foul 902 and spare 904 keys may be selected, if appropriate, to score these alternatives. A "strike" key area is missing from the selections because the bowler has selected to correct the second ball score and a strike is impossible. Alternatively, if a first ball correction was selected, a strike key area would have been included.

After the appropriate selections have been made, the bowler presses the "done" key area 910 and all corrections are recorded and the video display is corrected and updated. Alternatively, if the "quit" key area 912 was selected, the computer 102 clears the screen and re-displays the main menu screen as shown in FIG. 6 with no changes made. Therefore, a complete and accurate set of selections are presented to the bowler minimizing the number of incorrect choices or entry of inappropriate information.

Figure 10:
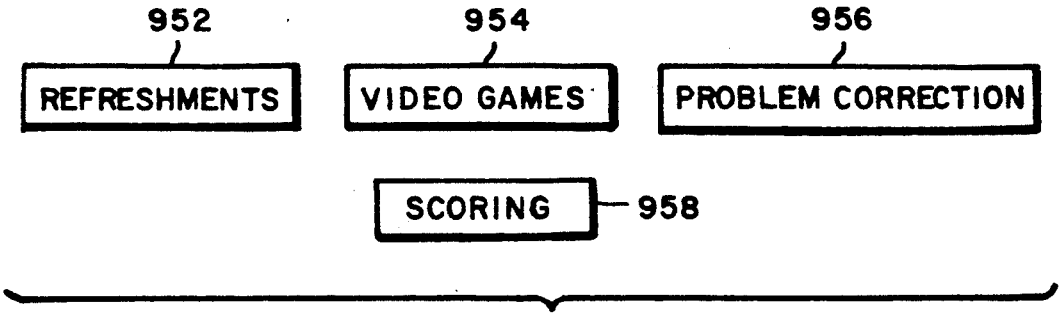
FIG. 10 is a schematic diagram of an alternative master menu touch-screen display.

FIG. 10 illustrates a master display for an alternative mode of operation wherein key areas 952–960 are provided for certain illustrative bowling alley functions. A given system may utilize any one or more of these functions and may contain additional menu items for bowling alley functions not shown in FIG. 10.

As before, the bowler using the system touches the appropriate key area on touch-screen 130 (FIG. 1) for the function which he desires to have performed. This causes additional information which is either stored in control computer 102 or which is obtained in the manner previously discussed over master video channel 150 to be provided to the bowler on the monitor of touch-screen display 130. For example, if the refreshments key area 952 is touched, this may cause a display of all foods and beverages available to be delivered to the bowling lane to appear on screen 130. In the alternative, this may cause a secondary menu to appear which may contain a menu of items such as "food", "non-alcoholic beverages", or "alcoholic beverages". The ultimate menu containing specific food and/or beverage items would list items and preferably also list prices. The user could then make selections from this menu by touching appropriate key areas, touching a "Done" key area such as key 910 when the order is completed. When this occurs, the monitor may indicate on the screen the total cost of the order and request that the user either enter a credit card number using number key areas appearing on the screen or pass a credit card through a card reader 123 provided with the system. If the system requests that the user enter a credit card number, this may be followed by a request that the user enter the expiration date of the credit card. Key pads may also be provided for indicating the credit card type (i.e., VISA, MASTERCHARGE, AMERICAN EXPRESS, etc.).

A voice output unit may be provided at the restaurant area, and in particular at the order filling area of the restaurant which, in response to menu selections by the user, causes a prerecorded voice output to be generated. Similarly, if the user activates the problem correction area 956, and then indicates a ball or pin problem, a voice output unit may generate a particular prerecorded message at the pin setting area behind the bowling pins to alert the attendant to correct the problem.

The sequence of operations which would occur if entertainment key area 954 is selected would be similar to those previously discussed. A menu of available entertainment options might include word games (for example questions and answer games), video games, cartoons, music, etc. The sequence of operations which would occur in the event scoring area 958 is selected has been discussed in some detail above. In addition, while the discussion above has assumed an automatic scoring capability, the system is also unable with a semi-automatic scoring capability, the system providing prompts and appropriate touch key areas to the user to permit the manual entry of pins which have been knocked down. Based on the information entered as to pins which have been knocked down, the system computes and displays scores.

If key area 960 is operated, a menu may appear permitting the patron to obtain information concerning future tournaments at the facility, league schedules, league standings, specials on clothing or equipment available from the bowling alley shop or special information which may be of interest to the particular user such as his current handicap or the like. The system may also permit the user to enter an indicated tournament, to indicate an interest in joining a league, or to sign up for some other bowling alley program such as lessons by operating appropriate key areas on the screen.

In addition to being used to read a credit card for charging information or similar purposes, or instead of this function, card reader 123 may be used to read a machine-readable membership card issued to regular patrons or a user's credit card to identify the user. In order to provide security so that someone coming into possession of a patron's membership card could not improperly receive or enter information concerning the patron or make charges to such patron, the system may also prompt the user/patron to enter a personal ID code on appropriate key areas, in addition to passing a card through card reader 123, thus enhancing the security of the system. Once a user is identified, either by passing a membership card or credit card through card reader 123, by the user entering a personal ID code into the system, or by a combination of these two means, the system can automatically cause stored information concerning the user to be entered into the system, thus substantially simplifying the initial system setup procedure. Further, the system may enter the scores recorded by the user into the computer, thus maintaining an archive record of the user's performance. This information may be used to automatically produce a handicap for the patron. The information concerning number of games bowled by a given patron/member and scores recorded by such member may be utilized to automatically determine league standings, and in awarding discounts, premiums or the like to frequent bowlers.

Thus, a system has been provided for performing a variety of bowling alley functions in a manner which is both versatile for the bowling alley and easy for the bowler to utilize. Further, while the invention has been described above with respect to a preferred embodiment and various modifications thereof, it is apparent that the forgoing and other changes in form and detail may be made therein by one skilled in the art while still remaining within the spirit and scope of the invention.

What is claimed is:

1. An interactive bowling alley system for a bowling alley having a plurality of lanes with a patron area for each lane comprising:

a computer adapted to store information concerning selected bowling alley functions, said functions including a problem correction function and at least one of a refreshment ordering function, a scoring function, an entertainment function, and an announcement function;

a touch-screen device located at the patron area for at least selected ones of said lanes, the touch screen device including a video monitor;

means responsive to said computer for causing a menu of said selected functions to appear on each video monitor, a key area being provided on the monitor for each displayed menu item;

means responsive to the user touching the key areas corresponding to one of the menu items shown on a video monitor for causing the computer to provide to the monitor and to display thereon selected information concerning the function corresponding to the touched key area, said selected information including a menu of available options for the selected function, there being a key area provided on the monitor for each available option and there being key areas provided on the monitor for operation by a user in performing a selected function, the information provided to the user when the problem correction function is selected being a menu of potential bowling alley problems;

means responsive to a user touching a key area for an available option for providing additional available options on the function and for causing the selected available option to be performed if additional available options are not stored, action being initiated to correct a selected problem in response to the user touching the key area for the problem on the problem correction menu; and means responsive to the user touching key areas in response to displayed instructions for causing the instruction to be performed;

whereby a user may easily perform the selected bowling alley functions without having prior computer knowledge or experience.

2. A system as claimed in claim 1 wherein one of said bowling alley functions is ordering refreshments; and wherein the information provided to the user in response to selection of the order refreshment function is a menu concerning available refreshments.

3. A system as claimed in claim 2 including a key area on the monitor for each refreshment menu item, and means responsive to a user touching a key area for automatically placing a refreshment order.

4. A system as claimed in claim 3 wherein said order placing means includes voice output means for providing a predetermined oral message at an order receiving site in response to a user touching each refreshment menu key area.

5. A system as claimed in claim 3 including means operative for permitting the automatic charging of an order.

6. A system as claimed in claim 1 wherein said bowling alley functions include selected entertainment functions;

wherein the information provided to the user in response to the selection of the entertainment function is a menu of available entertainment options, a key area appearing on said monitor for such entertainment option;

wherein the entertainment options include at least one game option;

means responsive to the selection of game options for displaying a menu of available games with associated key areas; and means responsive to a user touching the key area for a game option for displaying on the monitor material relating to the playing of the selected game option.

7. A system as claimed in claim 1 wherein said bowling alley functions include a scoring function; and wherein the information provided to the user in response to the selection of the scoring function is information concerning setting up the system to perform automatic scoring.

8. A system as claimed in claim 7 including pin scoring equipment for generating electrical signals indicative of the number of pins standing after each ball has been rolled, said computer including means responsive to said scoring signals and to key areas touched by the user for determining scores and selectively displaying such scores on the monitor.

9. A system as claimed in claim 1 wherein said system further includes a central source of audio and video signals and means for connecting said monitor to said central source of audio and video signals.

10. A system as claimed in claim 1 wherein said bowling alley functions include an announcement function;

wherein said information provided to the user in response to the selection of the announcement function includes a menu of available announcement options, a key area appearing on said monitor for each announcement option; and means responsive to a user touching the key area for an announcement option for displaying on the monitor material relating to the selected announcement option.

11. A system is claimed in claim 1 including means for permitting user identification information to be entered into the system.

12. A system is claimed in claim 11 wherein said means for entering user identification information includes a card reader.

13. A system as claimed in claim 12 wherein said means for providing user identification information further includes means for permitting a user to enter a personal identification code, whereby enhanced security on user identification is provided.

14. A system is claimed in claim 11 including means for storing selected information concerning a system user; and means responsive to the identification of a user in response to said means for providing user identification information for entering the stored information concerning the user into the system and for making selective use of such information.

15. A system as claimed in claim 1 including means responsive to the touching of a key area for a problem on a problem correction menu for providing a predetermined problem identifying message at a problem correction site.

16. A system as claimed in claim 15 wherein said message providing means includes voice output means for providing a predetermined oral message at a problem resolution site of the bowling alley in response to a user touching each potential problem key area.

* * * * *